US006005204A

United States Patent [19]

Choi et al.

[11] Patent Number: 6,005,204

[45] Date of Patent: Dec. 21, 1999

[54] MOTION SENSING SWITCH MOUNTED IN A NOVELTY DEVICE FOR GENERATING A SIGNAL DURING MOVEMENT

[76] Inventors: Andy Choi, Room 2801, New Trend Centre, 704 Prince Edward Road East, San Po Kong, Kowloon, The Hong Kong Special Administrative Region of the People's Republic of China; Robert F. Glaser, 1727 Fern Way, Cleveland, Ohio 44120; Clifford T. Rosenberg, 77 Robinson Road, Hong Kong, The Hong Kong Special Administrative Region of the People's Republic of China

[21] Appl. No.: 09/040,208

[22] Filed: Mar. 17, 1998

Related U.S. Application Data

[63] Continuation-in-part of application No. 08/920,254, Aug. 28, 1997.

[51] Int. Cl.[6] ..... H01H 35/00; F21V 33/00; B65D 23/00

[52] U.S. Cl. ..... 200/52 R; 215/6; 362/101

[58] Field of Search ..... 200/52 R, 61.45 R, 200/61.53, 61.45 M, 61.83, DIG. 29; 362/101; 215/6

[56] References Cited

U.S. PATENT DOCUMENTS

| | | | |
|---|---|---|---|
| 544,219 | 8/1895 | Godet | 215/6 |
| 1,289,218 | 12/1918 | Maiden | 215/6 |
| 1,728,883 | 9/1929 | Simon | 215/6 |
| 2,187,558 | 1/1940 | Kushima | 215/6 X |
| 2,663,866 | 12/1953 | Simpson | 200/52 R |
| 3,590,989 | 7/1971 | Wittwer | 215/6 X |
| 3,831,163 | 8/1974 | Byers | 200/61.45 R |
| 4,001,185 | 1/1977 | Mitsui et al. | 200/61.45 R |
| 4,297,683 | 10/1981 | Roberts | 200/61.52 X |
| 4,318,245 | 3/1982 | Stowall et al. | 200/61.52 X |
| 4,390,928 | 6/1983 | Runge | 362/806 X |
| 4,467,154 | 8/1984 | Hill | 200/61.45 R |
| 4,628,160 | 12/1986 | Canevari | 200/61.45 R |
| 4,988,839 | 1/1991 | Kennicott | 200/61.45 M |
| 5,017,748 | 5/1991 | Sapiro | 200/61.52 X |
| 5,040,719 | 8/1991 | Ballway | 215/6 X |
| 5,228,678 | 7/1993 | Matsuda et al. | 220/359.1 X |
| 5,339,548 | 8/1994 | Russell | 40/324 |
| 5,418,436 | 5/1995 | Powell | 318/497 |
| 5,487,486 | 1/1996 | Meneo | 215/6 X |
| 5,769,680 | 1/1998 | Hoffman | 215/6 X |

*Primary Examiner*—J. R. Scott
*Attorney, Agent, or Firm*—Kennedy, Davis & Hodge

[57] ABSTRACT

A motion actuated switch for operating a signalling apparatus for emitting a light or sound signal from within a novelty article, in which a switch body is defined by a cap attached to plate and the switch body being mountable within the novelty article. The plate has an electrically conductive first contact. At least a portion of the cap has an electrically conductive second contact. The cap and the plate define a cavity within the switch body. An electrically conductive sphere is disposed within the cavity for free movement therein and sized for at least momentarily contacting the first contact and the second contact upon motion of the novelty article. The switch is in electrical communication with a signalling apparatus by a first lead attached to the first contact and a second lead attached to the second contact. Upon closing the switch by imparting motion to the switch body, the electrically conductive sphere moves at least momentarily into electrically touching contact with the first and second switches. Novelty article preferably comprises a container for holding fluids for drinking while the motion actuates switch triggers the signalling apparatus to generate a signal during movement of the container. The novelty article can be an action toy or other novelty article.

2 Claims, 6 Drawing Sheets

MOTION SENSING SWITCH MOUNTED IN A NOVELTY DEVICE FOR GENERATING A SIGNAL DURING MOVEMENT

The present application is a continuation-in-part application of Ser. No. 08/920,254, filed Aug. 28, 1997.

TECHNICAL FIELD

The present invention relates to novelty articles such as containers for holding fluid or solid matter or toys. More particularly, the present invention relates to novelty articles having signalling devices responsive to motion actuated momentary switches for generating signals.

BACKGROUND OF THE INVENTION

It has been found that sales of goods, such as drinks, foods, convenience articles, and other goods sold to consumers, may be increased, promoted or facilitated, by including with the goods a premium separate from the goods being purchased. The premium induces the sale of the goods by offering to the consumer a perceived additional value at little or no additional cost to the consumer over the ordinary cost of the article. The additional value may take the form of a rebate, credit, discount, or second article. For example, toiletries and perfumes frequently are sold in combination with premium articles such as a separate container having a sample of related goods, a carrying case, or other similar articles.

The use of premiums is a marketing technique often used in combination with advertising and promotional campaigns in support of major motion pictures. Often there are "tie-ins" of goods or services offered by other companies. The companies involved pay licensing fees for the right to advertise, market, and sell "tie-in" products and services. The use of premiums as "tie-ins" for sales of goods is typically used in the "fast food" industry for inducing sales of foods. Fast food stores typically offer a children's meal together with a premium as an inducement to the parents through their children to purchase foods at the store for the child, and preferably, for the parent also, thereby increasing the overall sales of the store. The premium typically is enclosed in a separate container and placed with the food products in a bag for delivery to the consumer.

Often the premium is a novelty item associated with the advertising and marketing program of another, such as a major motion picture. The novelty article takes the form of a figurine, toy, or article related to or involved with the motion picture or similar promotion for consumers. In addition, the containers used for the fast food also typically include features in support of the marketing and promotional program. These features include story and illustrations related to the particular subject of the promotional program. For example, many such advertising and marketing programs provide special drink cups and bags with illustrations which tie-in or are associated with the promotional program.

The illustrations on the drink cups generally depict an action scene or other exciting incident from the tie-in program. Attention to key elements of the scene or incident is directed through the use of color and shapes. Heretofore it has not been practical to use a signalling device such as a light or sound to direct the attention to portions of the illustrated scene.

Novelty articles however have included switched signalling devices for generating lights and sounds. These novelty articles include toy vehicles, such as toy emergency police or fire vehicles and road construction equipment, and other toys, including monster-type creatures and action characters. The lights and sounds generally are initiated for brief durations by a button-switch located on an exterior surface of the toy.

Such switched devices however have not been entirely satisfactory during use. For example, the signal generating device must be re-actuated frequently by the user of the toy during play in order to continue the lights and sounds.

Accordingly, there remains a need in the art for an improved switch for actuating signalling devices in novelty articles during use.

SUMMARY OF THE INVENTION

The present invention meets the needs of the art by providing a motion actuated switch for operating a signalling apparatus within a novelty article, such as a toy, drinking cup, and the like. The motion actuated switch comprises a switch body which is define by a cap attached to plate. The switch body is mountable within a novelty article. An electrically conductive first contact attaches to the plate. At least a portion of the cap has an electrically conductive second contact. The cap and the plate cooperatively define a cavity within the switch body. An electrically conductive body is disposed within the cavity for free movement therein. The electrically conductive body is sized for being capable of at least momentarily touching both the first contact and the second contact upon motion of the switch body. The switch body includes a first lead which is attached in electrical communication with the first contact and a second lead attached in electrical communication with the second contact. The switch is closed for electrical communication upon imparting motion to the switch body, whereby the electrically conductive body is caused to move at least momentarily into touching both the first and second contacts.

More particularly described, the cap is dome-shaped and is itself electrically conductive, thereby defining the electrically conductive second contact. The switch is electrically connected to a signalling device which, responsive to the momentary closing of the electrical circuit, generates a signal, such as emitting a light or generating a sound upon activation of the signalling device by the switch.

In preferred embodiment, the motion actuated switch of the invention described above is mounted within a novelty article for activation of a signalling device upon motion of the novelty article. In a preferred embodiment, the novelty article is a container for holding at least one first article in a space defined by walls of the container while the motion actuated switch and signalling device is held within a separate compartment therein. In one aspect of the invention, the container comprises a cup for holding a fluid for drinking while enclosing the signalling device and motion actuated switch within a separate compartment of the cup. In another aspect, the container comprises a body formed from a foldable blank of sheet material. The motion actuated switch and signalling device also mounts within a toy such as a wheeled movable vehicle, action toy, or other article.

Objects, advantages and features of the present invention will become apparent from a reading of the following detailed description of the invention and claims in view of the appended drawings.

DETAILED DESCRIPTION OF THE PREFERRED EMBODIMENT

Figure 1:
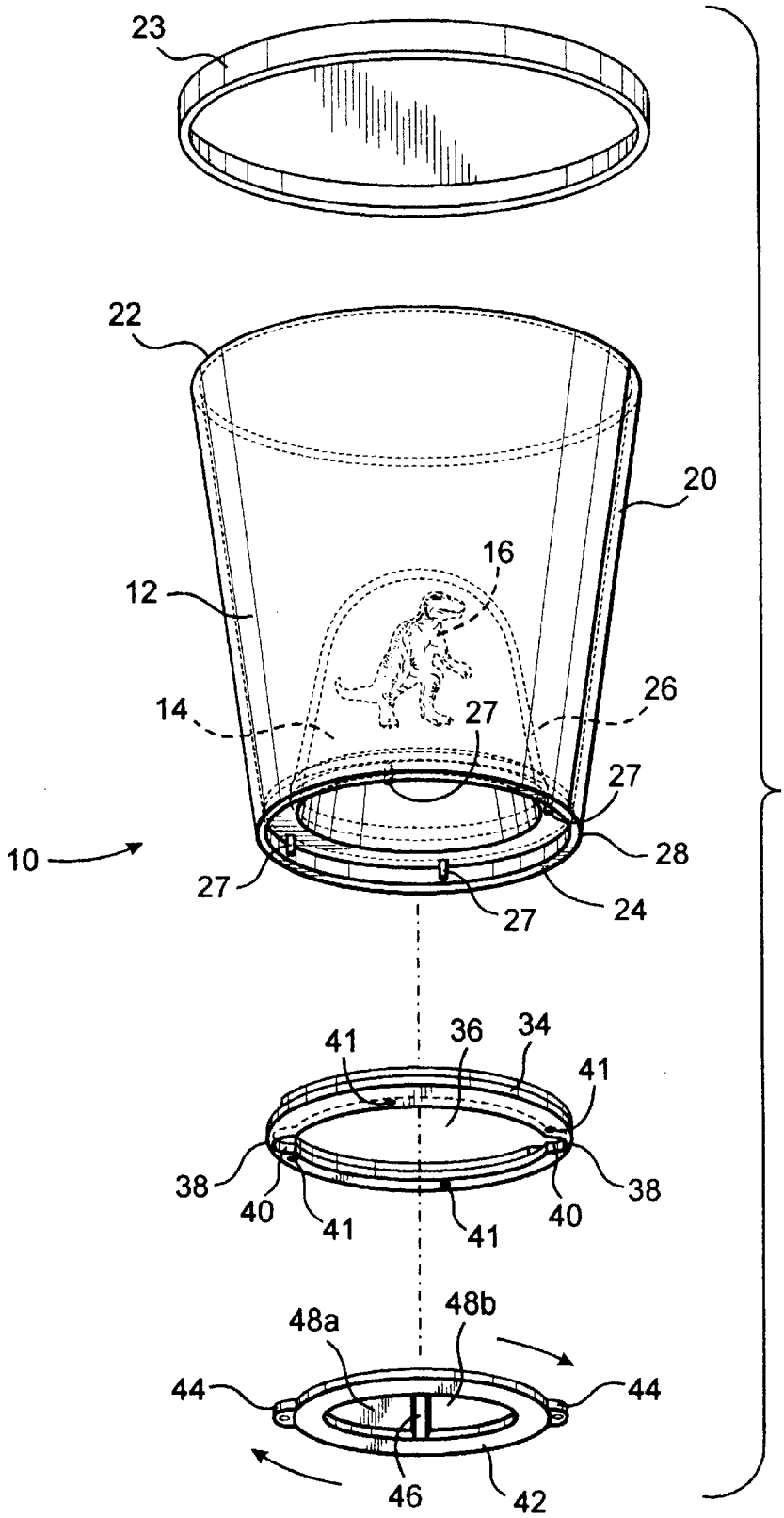
FIG. 1 is a perspective exploded view of a container according to the present invention.

Referring now in more detail to the drawings, in which like numerals indicate like parts throughout the several views, FIG. 1 illustrates in perspective exploded view a cup 10 constructed in accordance with the present invention for a container which functions for holding goods, such as fluids or discrete articles, in a cavity 12 while also providing a selectively accessed compartment 14 for enclosing a novelty article or premium 16 such as the toy dinosaur illustrated in phantom. A preferred embodiment of the container 10 defines a drinking cup. The cup 10 is defined by a continuous side wall 20, which in the illustrated embodiment the cup 10 defines an inverted frustroconical body having an upper open end 22 and a lower open end 24. A cap 23 is selectively placed on the open end 29 to close the cup 10. An interior wall 26 forms a closed bottom for the cup 10. The interior wall 26 in the illustrated embodiment defines a dome in which the apex is disposed in a central portion of the cavity 12 and the lower edge is integral with the side wall 20 at a lower portion 28 of the cup 10. The sidewall 20 and the interior wall 26 accordingly define the open ended cavity 12 within the cup 10 for receiving goods. A plurality of pins 27 extend outwardly through the open end 24 from a lower surface of the interior wall 26 near the side wall 20, for a purpose discussed below.

The interior wall 26 also defines the cavity 14 in the lower portion 28 of the cup 10 which is accessed through the lower end 24 of the cup. A ring 34 is received by the lower end 24, as discussed in detail below. The ring 34 defines an opening 36. In the illustrated embodiment, the ring 34 has two oppositely-disposed narrowed portions 38 which define U-shaped portions or recesses 40 of the opening 36 in opposing sides of the ring 34. Four openings 41 are defined in the ring 34, which openings align with the pins 27 for positioning the ring on the cup 10.

The ring 34 receives a cover plate 42 for closing the cavity 29. A pair of ears 44 extend outwardly from the cover plate 42 on opposing sides. The ears 44 are sized for being received through the recesses 40 for engaging the cover plate 42 to the ring 34, as discussed below. The cover plate 42 has a cross-member 46 which in the illustrated embodiment is disposed substantially transverse to a line defined by the pair of ears 44. The cross-member 46 divides the cover plate 42 into two recessed spaces 48*a*, 48*b* for receiving fingers, whereby the cover plate 42 may be rotated relative to the ring 34, as discussed below. In an alternate embodiment, the narrowed portions 38 are not oppositely disposed, so as to define a key so that the cover fits it a selected orientation only.

Figure 2:
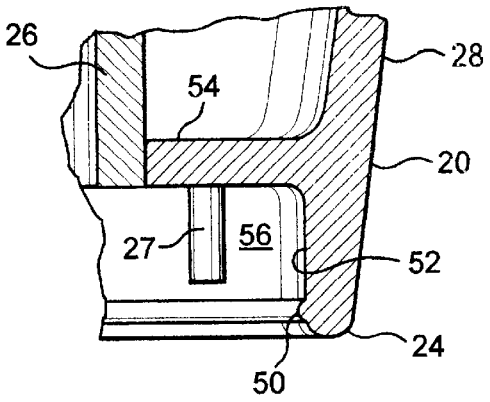
FIG. 2 is a detailed cross-sectional view of a lower portion of the container illustrated in FIG. 1 to show features of the container.

FIG. 2 is an enlarged detailed view of the lower portion of the cup 10 shown in FIG. 1. A flange 50 extends laterally inwardly from an interior surface 52 of the sidewall 20 near the lower end 24. The interior wall 26 is integrally engaged to the sidewall 20 by a substantially transverse portion 54 of the interior wall 26. The transverse portion 54 and the lower portion of the sidewall 20 cooperatively define a channel 56 in the lower portion of the cup 10 for receiving the ring 34. The pins 27 extend from a lower surfaces of the transverse portion for mating engagement of the ring 34 to the bottom of the cup, as discussed below. Accordingly, the transverse portion 54 can be viewed as a bottom wall defining an opening into the cavity 14 and integrally connected to an interior dome-shaped wall, which together defines the cavity 14.

Figure 3:
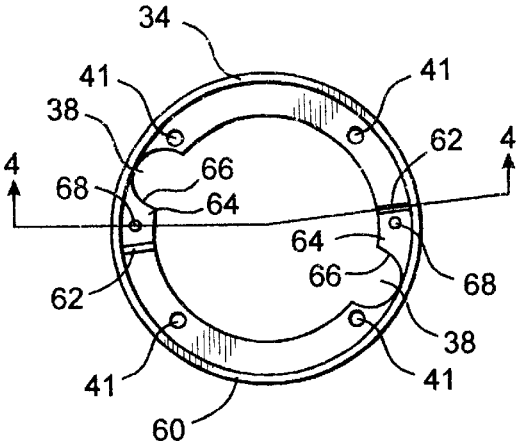
FIG. 3 is a top plan view of a ring received in a lower end of the container illustrated in FIG. 1.
Figure 4:
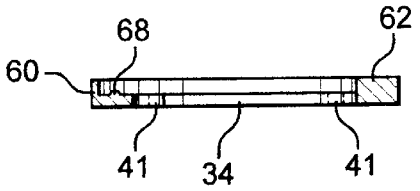
FIG. 4 is a cross-sectional view of the ring illustrated in FIG. 3, taken along line 4—4.

FIG. 3 is a top plan view of the ring 34 and FIG. 4 is a cross-sectional view of the ring 34 taken along lines 4—4. A skirt 60 extends upwardly around a perimeter edge of the ring 34. A pair of walls 62 extend laterally inwardly from the skirt 60 on opposing sides of the ring 34. The walls 62 are spaced from the narrow portion 38 and define a shelf 64 in the ring 34 between the wall 62 and an edge 66 of the narrow portion 38 of the ring 34. A lug 68 extends upwardly from the shelf 64. The four openings 41 are defined in the ring 36. In the illustrated embodiment, the openings 41 are equally spaced around the perimeter of the ring 34, for alignment with the pins 27 as discussed below.

Figure 5:
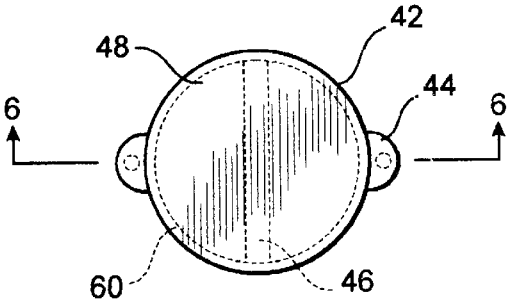
FIG. 5 is a top plan view of a cover plate received by the ring illustrated in FIG. 3 for closing the container illustrated in FIG. 1.
Figure 7:
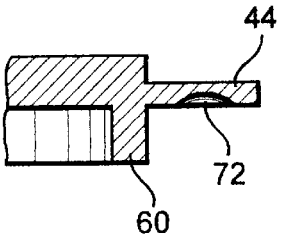
FIG. 7 is a detailed cross-sectional view of an ear of the cover plate illustrated in FIG. 5, taken along line 7—7.
Figure 6:
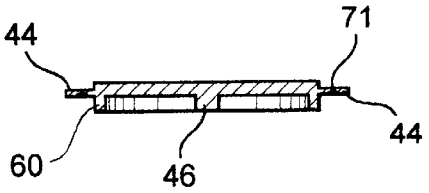
FIG. 6 is a cross-sectional view of the cover plate illustrated in FIG. 5, taken along line 6—6.

FIG. 5 is a bottom plan view of the cover plate 42 and FIG. 6 is a cross-sectional side view taken along 6—6 of FIG. 5. The ears 44 extend laterally on opposing sides of the cover plate 42. The ears 44 are preferably off-set generally 71 relative to an upper surface 70 of the cover plate 42. As best illustrated in FIG. 7, the lower surface of the ears 44 each define a dish-shaped recess 72. The cross-member 46 divides the cover plate into the two recessed sections 48*a* and 48*b*.

Figure 8:
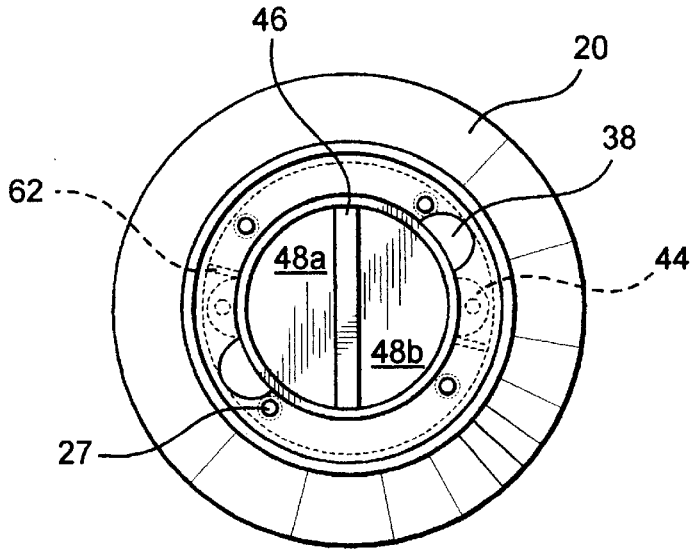
FIG. 8 is a bottom view of the container illustrated in FIG. 1.

The operation of the cup 10 is understood with reference to FIGS. 1 and 8. FIG. 8 is a bottom view of the top 10 illustrated in FIG. 1. The ring 34 is matingly received in the channel 56 by aligning the openings 41 with the pins 27. In the illustrated embodiment, the perimeter edge of the ring 34 closely aligns with the interior surface 52 of the sidewall 20 near the lower end. The ring 34 preferably snaps into place in the channel 56 and is held therein by the flange 50 which extends around the interior perimeter of the sidewall 30. The pins 27 extend through the openings 41. The distal ends of the pins 27 are briefly heated and melted to define rivets securing the ring 34 to the bottom of the cup 10. An alternate embodiment however does not include the pins 27. Rather, the location of the pins in the illustrated embodiment define openings which align with the openings 41 in the ring. A screw or plastic plug extends through the openings 41 and into the aligned openings in the bottom of the cup 10 in order to engage the ring 34 to the cup 10.

Upper edges of the perimeter skirt 60 and the walls 62 contact the lower surface of the transverse portion 54 of the inner wall 26. A space is thereby defined between the transverse portion 54 and the shelf 64 in the ring 34.

One of the novelty articles 16, such as the toy dinosaur illustrated in FIG. 1, is then inserted through the open end 24 into the cavity 14. The cover plate 42 is thereafter positioned on the ring 34. The ears 44 are positioned in the recesses 40 which define key spaces for receipt of the ears.

With reference to FIGS. 3 and 8, the cover plate 42 is gripped with fingers in the recesses 48*a*, 48*b*. A twisting pressure is applied to the cross-member 46 in order to rotate the cover plate 42 relative the ring 34. The ears 44 pass over the edge 66 of the shelf 64. The ears 44 travel in the space defined between the transverse portion 54 and the shelf portion 64. The recesses 72 engage the respective lugs 68 in the shelf 64, as shown in broken line in FIG. 8, to secure the cover plate 42 to the ring 34 and thereby close the cavity 14. Other detent/engagement mechanisms are gainfully employed, such as a friction fit sloping surface. The cup 10 thereafter may be used as a container for holding goods, such as a liquid. The novelty article 16 is contained within the dome-shaped cavity 14.

In a preferred embodiment, the cup 10, the ring 34, and the coverplate 42 are manufactured by molding with a clear K-resin plastic. The novelty article 16 is visible through the sidewall 20. The novelty article 16 is selectively removable from the cup while it continues to function as a container for liquids. This is accomplished by holding the cup 10 in the air, inserting fingers into the recesses 48*a*, 48*b*, and imparting a twisting pressure against the cross-member 46. The lugs 68 detach from the recesses 72 in the ears. The ears 44 enter the recesses 40 and the cap 42 is thereby disengaged from the ring 34. The article 16 is then removed from the cup 10. The cup 10 continues to function as an enclosing article for the liquids contained within the cavity 12. In an alternate embodiment, the open end 22 is selectively closed by the close fitting lid 23 in order to prevent the liquids from slopping over the sides of the cup 10.

Figure 9:
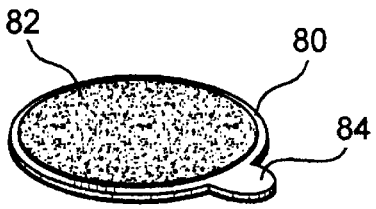
FIG. 9 is a plain view of an alternate embodiment of a cover for closing the novelty-holding cavity in the cup illustrated in FIG. 1.

In another embodiment best illustrated in FIG. 9, the open end 24 is closed by a paper sticker 80 having an adhesive layer 82. The adhesive layer 82 engages the lower surface of the transverse portion 54. In the illustrated embodiment, the adhesive layer 82 defines a shape corresponding to the perimeter of the opening 36 in the ring 34. A tab 84 is grasped in order to remove the sticker 80 from closing the cavity 14 that holds the novelty article 16. In this embodiment, the lower end 24 of the cup 10 does not include the pins 27. Further, the ring 34 and the cap 42 are not used, resulting in a possible reduction in cost while the cup 10 of this embodiment functions to hold liquids within the cavity 12 while providing selective access to the novelty article 16 in the cavity 14.

Figure 10:
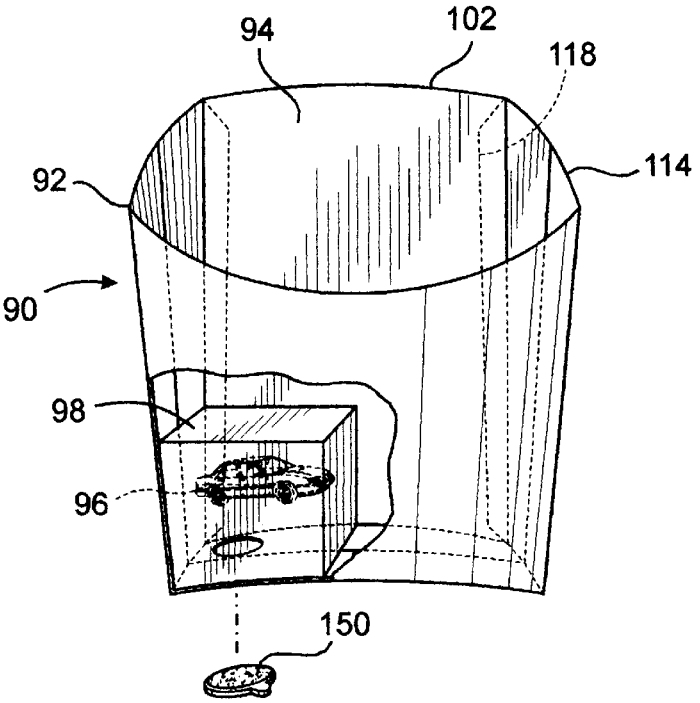
FIG. 10 is a perspective view of an alternate embodiment of a container according to the present invention.

FIG. 10 is a perspective view of alternate embodiment of a container 90 according to the present invention. The container 90 provides a body 92 that defines a cavity 94 for holding articles while also defining a separate, selectively accessed compartment 98 for enclosing a novelty article 96. The container 90 is formed from a blank 100 which folds and attaches together to define a back wall 102, a bottom 104, and a front wall 106. The blank 100 is made of a sheet material, and preferably, is made of a sheet material conventionally known as paperboard.

Figure 11:
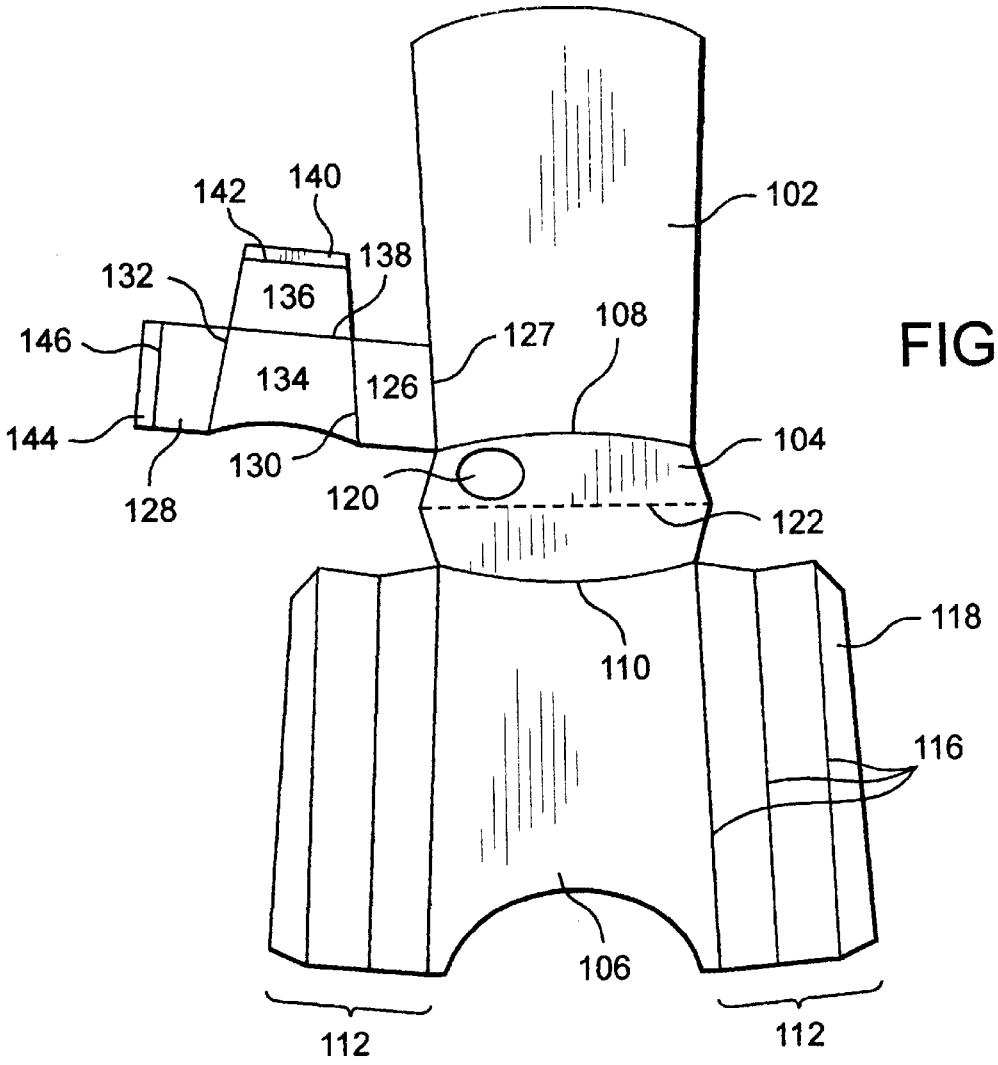
FIG. 11 is a plan view of a blank for forming the container illustrated in FIG. 10.

As illustrated in the plan view of FIG. 11, the blank 100 includes scores 108 and 110 which separate the back wall 102 and the bottom 104 and the bottom 104 and the front wall 106, respectively. The front wall 106 includes lateral portions 112 which define side walls 114 of the container 90. The side walls 114 are defined by three spaced-apart scores 116 which permit the lateral portions 112 to fold in order to define the respective side walls 114 extending between the front wall 106 and the back wall 102. Lateral surfaces 118 of the lateral portion 112 fold over and engage a back surface of the back wall 102 in order to form the body 92 which defines the cavity 94. The bottom 104 defines an opening 120 for receiving there through the novelty article 96. A score 122 extends laterally between side edges of the bottom 104.

A compartment-defining flap 125 extends laterally form an edge of the back panel 102. The flap 125 defines a pair of side panels 126 and 128 foldably divided by scores 130 and 132 form a cross panel 134. A top 136 is foldably engaged to the cross panel 134 by a score 138. A flap 140 is defined in a distal edge portion of the top panel 136 by a score line 142. A laterally distal edge portion is defined by a score 146 in the side panel 128.

The blank 100 is formed into the container 90 by folding the flap 125 on the scores 127, 130, 132, and 146. The side flap 144 is attached to an interior face of the back wall 102. The top panel 136 is folded on the score 138 and the score 142. The distal portion 140 is adhered to the interior surface of the back wall 102, thereby defining the compartment 98 which is open from the bottom.

The body 92 is then formed. The lateral portions 112 of the front wall 106 are folded on the scores 116. The lateral portion 118 is adhered to a back surface of the back wall 102, thereby defining the container 90 having the cavity 94. The novelty article 96 is received within the compartment 98 through the opening 120. A cover 150 is attached with adhesive to the lower surface of the bottom wall in order to close the opening 120.

The container 90 is thereafter used for holding articles within the cavity 94 such as french fries, while also enclosing the novelty article 96 within the separate selectively accessed compartment 98. The novelty article 96 is removed by disengaging the cover 150 from the bottom of the container 90. The container 90 however continues to function for the purpose of holding the goods within the cavity 94. It is to be especially noted that other layouts of the blanks 100 may be gainfully used to provide a container according to the present invention.

The present invention accordingly provides a container for holding goods, particularly such as drinks or food items, together with a premium or novelty article, selectively accessible in a compartment within in the container while the container functions for its primary purpose of holding the goods.

Figure 12:
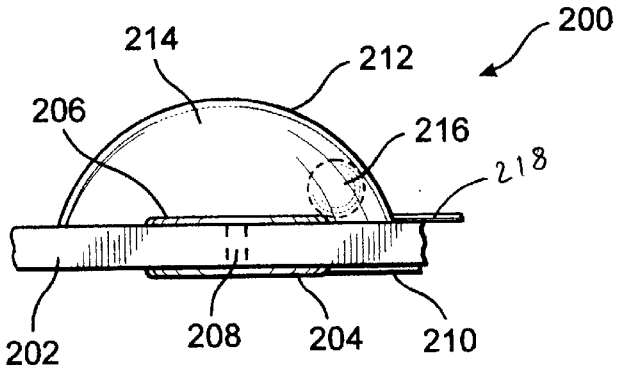
FIG. 12 is a side view of a motion actuated switch according to the present invention.

FIG. 12 is an enlarged side view of a motion actuated switch 200 according to the present invention. The switch comprises a plate 202, such as a printed circuit board, having an electrically conductive contact 204 attached to the plate. In the illustrated embodiment, the electrically conductive contact 204 comprises a metal disk 206 connected by a pin 208 extending through the plate 202. A first, electrically conductive lead, or wire 210 attaches at one end in electrical communication with the pin 208. A dome shaped cap 212 attaches to a first surface of the plate 202. The cap 212 and the plate 202 define a cavity 214 in the switch 200. In the illustrated embodiment, the cap 212 is metal. In an alternate embodiment, the cap includes an electrically conductive band on an inside surface for defining a second contact in the switch. The cap 212 is attached to the plate 202 by solder, adhesive, ultrasonic welding, or other conventional attaching mechanisms. An electrically conductive body 216 is disposed within the cavity 214 for free movement therein. The electrically conductive body 216 in the illustrated embodiment is a spherical ball sized for at least momentarily touching the first contact and the cap. A second electrically conductive lead, or wire, 218 attaches at a first end in electrical communication with the cap 216.

Figure 13:
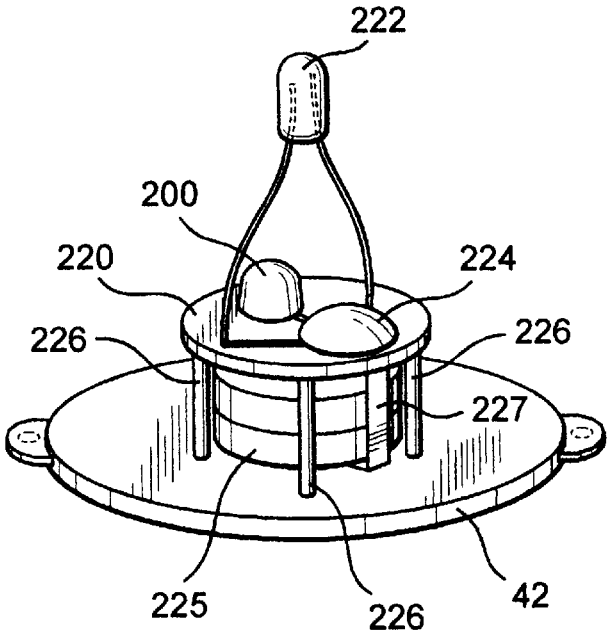
FIG. 13 is a perspective view of the motion actuated switch illustrated in FIG. 12 as being mounted to the cover plate illustrated in FIG. 5.

FIG. 13 is a perspective view of the motion actuated switch 200 attached to a printed circuit board 220 for controlling a light emitting diode (LED) 222 in response to actuation of the switch 200. The circuit board 220 includes an LED driver 224. Legs 226 extend from the board 220 and connect to the cover plate 42 for the cup 10 illustrated in FIG. 15. A power supply comprising a pair of batteries 225 mounts between the board 220 and the cover plate 42. The electrical contacts for the power supply connect through the circuit board 220 to the LED driver 224. (A wire 227 is illustrated as connecting one contact of the power supply 225 to the LED driver 224.) The LED driver 224 is a conventional integrated circuit for causing a light emitting diode 222 to emit light. The first lead 210 and the second lead 218 connect conventionally through the printed circuit board to the power contacts of the LED driver 224 on the circuit board 220. The LED connects to the driver conventionally. In a preferred embodiment, the LED driver is an integrated circuit substrate part number A5413 manufactured by Hua Ko Electronics Company, Limited, of Hong Kong. Other conventional LED drivers may be used.

Figure 14:
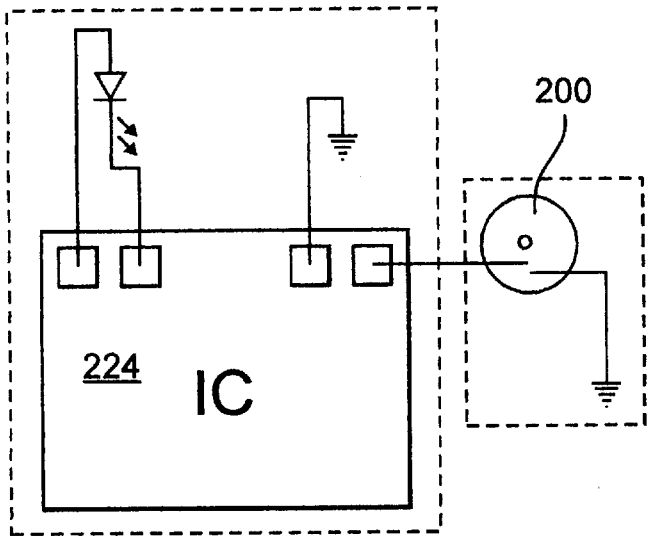
FIG. 14 is a schematic view of the circuit for the motion actuated switch illustrated in FIG. 12.
Figure 15:
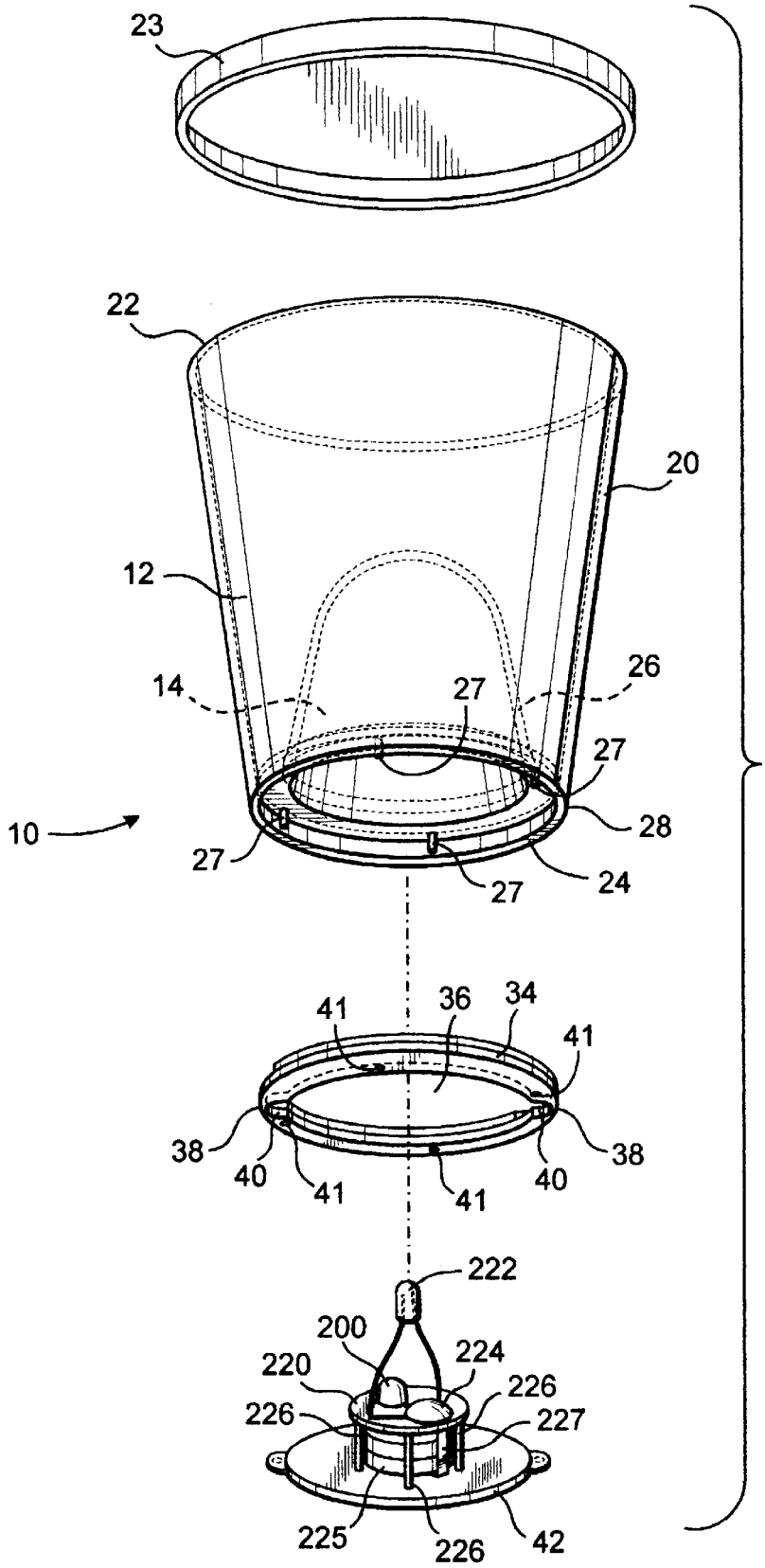
FIG. 15 is a perspective exploded view of the container illustrated in FIG. 1 with the switch illustrated in FIG. 13, according to the present invention.

With reference to FIG. 15, the cover plate 42 closes the opening 36 in the cup 10. The LED 226 is disposed within the cavity 14. When the cup 10 is picked up or moved, the ball 216 rolls on the plate 202 within the cavity 214. Upon momentary contact of the ball 216 with the cap 212 and the plate 202, an electrical circuit is closed whereby power can flow from the power supply, through the metal plate 202, the electrically conductive body 216, and the cap 212, back to the power supply. With reference to FIG. 14, the closing of the switch 200 triggers a signal to the LED driver 224. With respect to IC substrate A5413, when the switch 200 is closed, the switch pin of the IC is pulled to a low potential. The LED pin of the IC will then drive the LED to flash at a predetermined rate for a predetermined period of time. In the illustrated embodiment, the LED flashes at four hertz for twelve pulses. The IC then stops the LED from flashing until the next triggering event of the momentary contact of the electrical conductive body 216 with the metal disk 206 and the cap 212. In this manner, the cup 10 will substantially flash while the cup is being moved for drinking fluids, yet cease flashing when the cup is set down and stationary.

In an alternate embodiment, the plate 202 comprises a star-burst pattern of copper lines radiating from a central portion of the plate 202. The spherical ball 216 rolls on the copper trace pattern. The gaps between the lines of the copper trace are sufficiently close so that the ball makes contact with at least one, whereby the switch 200 is closed upon contact of the ball with the cap 212.

In an alternate embodiment, the plate 202 is shallowly dished to define a concave central portion. In this manner, the electrically conductive ball 216 is biased to the central portion of the cavity 214 away from the metal cap 212. To minimize activation of the signalling device during shipment, novelty articles having the switch are packaged and shipped inverted in containers.

The use of the motion actuated switch 200 of the present invention is not limited to novelty articles such as the container disclosed herein. Indeed, the switch 200 is readily used in a range of movable devices, including toys, stuffed animals, packages, cards, and so forth. For example, the switch 200 is useful in toy vehicles to actuate lights and sound as the toy is moved, but allows the lights and sound to stop after play. In this embodiment (not illustrated) at least one LED is attached to an exterior surface of a toy vehicle 240. The LED is connected to the LED driver, such as the A5413 LED driver described above. The switch 200 connects through the first lead 210 and the second lead 218 to the LED driver. Upon rolling movement of the toy car, the switch 200 is closed by momentary contact of the ball 216 with the metal disk 206 and the cap 212. Upon closure of the switch 200, an electrical signal is communicated to the LED driver to activate the LED 242. In this embodiment, the switch 200 is also in electrical communication with a sound generating chip whereby the novelty toy also generates a sound signal in response to closing of the switch 200.

The principles, preferred embodiments, and modes of operation of the present invention have been described in the foregoing specification. The invention is not to be construed as limited to the particular forms disclosed because these are regarded as illustrative rather than restrictive. Moreover, variations and changes may be made by those skilled in the art without departure from the spirit of the invention as described by the following claims.

What is claimed is:

1. A drinking cup for holding a fluid for drinking while generating a signal, comprising:

a frustroconical body defined by a side wall and having an open end for receiving therethrough a fluid for being contained within the body;

a dome-shaped bottom wall in a lower portion of the body cooperating with the side wall to define a first cavity in the body for receiving and containing the fluid and defining a second cavity in the body;

the lower edge of the side wall defining an opening for selective access into the second cavity;

a cover plate for closing the opening into the second cavity;

a signal-generating device attached to said cover plate, said signal-generating device comprising a signal driver selectively actuated by a switch, a supply of power to operate said signal driver, and signal means responsive to the signal driver for making a signal responsive to the signal driver, connected together for electrical communication;

said switch comprising a plate having an electrically conductive first contact and a metal cap attached to the plate, the cap defining a second cavity;

an electrically conductive ball disposed within the second cavity for free movement therein and sized for at least momentarily contacting said first contact and said cap in response to motion of the body;

a first lead attached in electrical communication between the first contact and the signal driver; and a second lead attached in electrical communication between the cap and the signal driver, whereby the electrically conductive ball, being momentarily in electrical communication with the first contact and the cap upon motion of the body, closes an electrical circuit to actuate the signal driver to generate a signal by the signal means, the signal-generating device being selectively accessible upon removal of the coverplate.

2. A cup for holding a fluid for drinking while enclosing a lighted signaling device in a separate, selectively accessible compartment therein, comprising:

a cup-shaped body defined by a side wall and having an open end; for receiving therethrough a fluid for being contained within the body;

a dome-shaped bottom wall in a lower portion of the body cooperating with the side wall to define a first cavity in the body for containing a fluid received therein through the open end, the bottom wall defining a second cavity in the body;

a plurality of spaced-apart pins extending longitudinally from the bottom wall;

a lower edge of the side wall defining an opening for selective access into the second cavity;

a ring engaged to a bottom edge of the body and defining an opening through for access into the second cavity, the ring defining a plurality of openings for aligning with and receiving the pins which define rivets for securing the ring to the bottom wall; and a cover plate received by the ring for closing the opening to the second cavity;

a signal-generating device attached to said cover plate, said signal-generating device comprising a signal driver selectively actuated by a switch, a supply of power to operate said signal driver, and a signal means responsive to the signal driver, connected together for electrical communication;

said switch comprising a plate having an electrically conductive first contact and a metal cap attached to the plate, the cap defining a third cavity;

an electrically conductive ball disposed within the third cavity and sized for at least momentarily contacting the cap and the first contact upon motion of the body;

a first lead attached in electrical communication between the first contact and the signal driver; and a second lead attached in electrical communication between the cap and the signal driver, whereby the electrically conductive ball, being momentarily in electrical communication with the first contact and the cap upon motion of the body, closes an electrical circuit to actuate the signal driver to generate a signal by the signal means, the signal-generating device being selectively accessible upon removal of the cover plate.

* * * * *